United States Patent [19]

Nolan

[11] 4,273,397

[45] Jun. 16, 1981

[54] FILING CASE HAVING REMOVABLE, EXPANDING FILE

[76] Inventor: Lily P. Nolan, 4248 D'youville Trace, Atlanta, Ga. 30341

[21] Appl. No.: 74,057

[22] Filed: Sep. 10, 1979

[51] Int. Cl.[3] ..... A47B 83/00; A47B 63/00; B65D 27/08

[52] U.S. Cl. ..... 312/237; 312/183; 312/204; 312/233; 229/72

[58] Field of Search ..... 312/237, 183, 188, 193, 312/185, 293, 233, 204; 229/1.5 R, 72

[56] References Cited

U.S. PATENT DOCUMENTS

| | | | |
|---|---|---|---|
| 226,717 | 4/1880 | Clacher | 312/204 |
| 314,598 | 3/1885 | Meek | 229/72 |
| 440,479 | 11/1890 | Kelly | 312/233 |
| 622,940 | 4/1899 | Brydges | 312/183 |
| 821,019 | 5/1906 | Cooke, Jr. | 229/72 |
| 909,734 | 1/1909 | Zoerb | 229/72 |
| 1,489,730 | 4/1924 | Baker | 229/72 |
| 1,745,249 | 1/1930 | Doughty | 229/1.5 R |
| 1,876,779 | 9/1932 | Smith | 312/293 |
| 2,670,261 | 2/1954 | Mueller | 312/204 |
| 2,756,515 | 7/1956 | Hoffman | 229/72 |
| 3,224,661 | 12/1965 | Tilton, Jr. | 229/72 |
| 3,973,813 | 8/1976 | Nesmith, Jr. | 312/293 |
| 4,124,261 | 11/1978 | Klaus | 312/233 |

FOREIGN PATENT DOCUMENTS

| | | | |
|---|---|---|---|
| 1786607 | 1/1975 | Fed. Rep. of Germany | 312/183 |
| 422598 | 3/1911 | France | 312/233 |
| 370747 | 9/1963 | Switzerland | 312/183 |

*Primary Examiner*—Victor N. Sakran
*Attorney, Agent, or Firm*—Patrick F. Henry

[57] ABSTRACT

The present filing system comprises a filing case which may resemble a book with one or more open compartments in which is removably positioned an expanding file envelope which may have a flap on one end to conceal the corrugated edges of the expanding envelope. The envelope is compressed and slid into and out of the case and may be used to hold photographs, recipes, coupons or other material.

3 Claims, 4 Drawing Figures

FILING CASE HAVING REMOVABLE, EXPANDING FILE

BACKGROUND OF THE INVENTION

1. Field of the Invention

Filing cases, filing envelopes, expanding envelopes and filing systems comprising a fixed case and removable drawers or containers.

2. Description of the Prior Art

Expanding envelopes and accordion type cases are well known in the art and are manufactured from many different materials such as cardboard and laminated paper as well as lightweight metal and fabric or plastic. Expanding cases and envelopes are shown in very old U.S. Patents such as Tapley U.S. Pat. No. 213,852 in 1879, or Zoerb U.S. Pat. No. 909,734 of 1909. Such cases are essentially covers for expanding envelopes which remain inside and all co-act together. Other types of expansible or expanding files are shown in U.S. Pat. Nos. 1,489,730; 1,745,249 and 3,224,661 which are expansible files having covers or cases arranged in different fashions. However, none of these patents disclose a fixed case which can simulate a nice looking book and having a fixed compartment into which one or more expanding files have been collapsed and inserted so as to be concealed but for complete removal and detachment from the case.

SUMMARY OF THE INVENTION

The present invention has to do with a fixed case or container arranged to simulate a book which is placed on a shelf in the usual manner of any book. Of course, the case is hollow and has no pages and the inside front edge of the book which is opposite from the usual book spline is open to provide access to the inner compartment. An expanding file is inserted into the open compartment and the file is manufactured with dimensions to correspond with the space within the book. By providing separators or ledges within the compartment it is possible to have more than one expanding file of smaller size. This is especially useful for filing photographs, recipes, coupons, and the like.

An object of this invention is to provide a combination of a case and expanding file which may be readily removed and inserted.

Another object of this invention is to provide a decorative and attractive case which may resemble a book to hold and conceal one or more expanding files that are easily removable and replaced.

An additional object of this invention resides in the simplicity of construction of the case which may be manufactured to accommodate existing sizes of expanding files whereby there is a selectivity of sizes of books and sizes of expanding files.

Other and further objects and advantages of this invention will become apparent upon reading the following description of a preferred embodiment taken in conjunction with the accompanying drawings.

DESCRIPTION OF A PREFERRED EMBODIMENT

Figure 1:
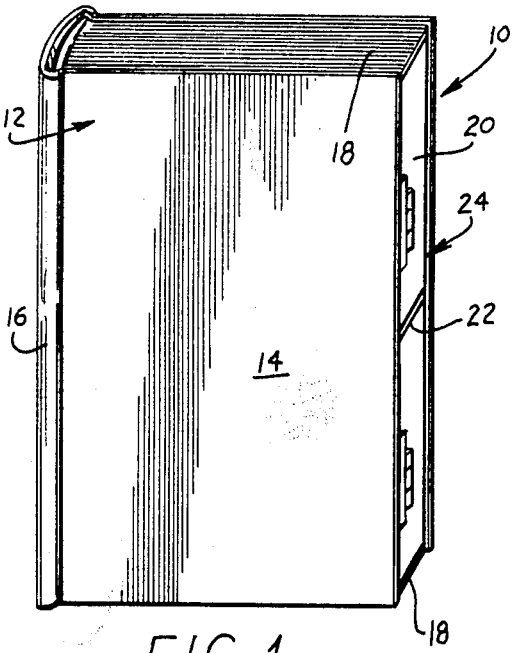
FIG. 1 is a perspective view of one preferred form of the present invention as it would be found normally on a shelf.

In FIG. 1 the complete file system 10 comprises an outer case or container 12 which is manufactured to simulate an attractive book. Case 19 may be manufactured in any number of different sizes and shapes and relative dimensions as well as different materials and is readily made from paperboard or fiberboard covered with simulated leather material to cover the sides 14, the spline 16 and there are top and bottom edge enclosures 18 manufactured from paperboard or the like to simulate the pages of a book on each of the edges 18.

The interior of the case 10 is of fixed dimension and hollow to provide one or more compartments 20 which are separated by dividers or ledges 22 manufactured from wood, paper or the like of sufficient strength and rigidity to support the filing envelope 24 which is inserted into the space 26 inside the case 12.

Figure 3:
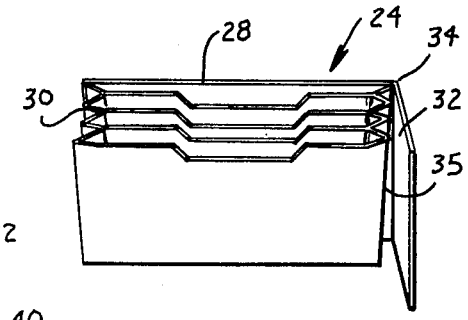
FIG. 3 is a front perspective view of one of the removable, expanding envelopes of the present invention.
Figure 2:
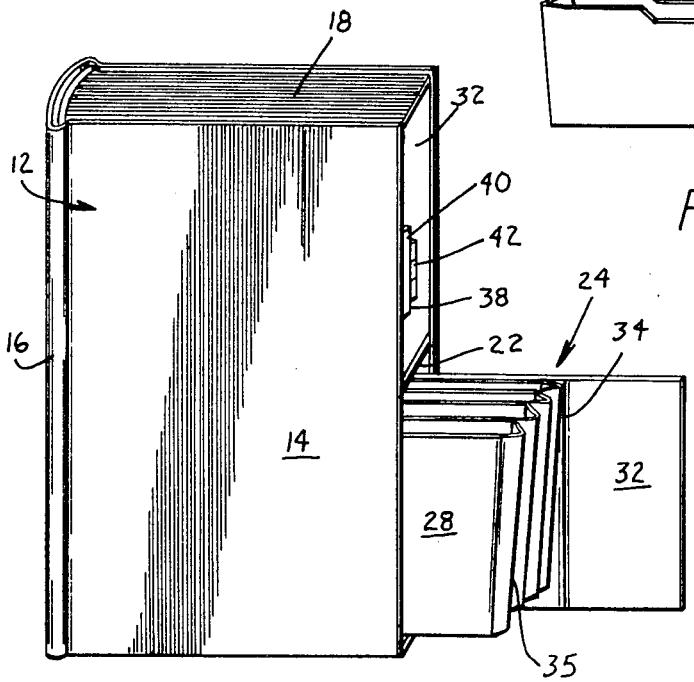
FIG. 2 is a perspective view similar to FIG. 1 but with one of the expanding envelopes partially inserted.

Each expanding envelope 24 may be of one of many types of conventional construction such as fiberboard or treated paperboard panels 28 connected together by plastic or fabric webs 30 arranged in a corrugated fashion in the manner, for example, of the accordion filing envelopes shown in the patent set forth in the description of the prior art herein. Such accordion filing envelopes 24 may be manufactured in any size, shape or dimension as well as quality of construction ranging from very fine specially treated fiber or paperboard connected by cloth or plastic webs or gussets down to very cheap or inexpensive cardboard panels connected by inexpensive paper gussets. In the form of present device in FIG. 1, however, each filing envelope 28 is provided with a front flap or panel 32 connected along one edge 34 to the filing envelope 28 by means of tape forming gussets 35 or having been originally formed integrally with the back panel 28. The panel 32 functions as a closure flap which is inoperative when the expanding envelope 28 is out of the case 14 (in the manner shown in FIG. 3) but becomes operative (as shown in FIG. 2) upon the insertion of the expanding envelope 24 into the compartment 26 and the case 4 and (in the manner shown in FIG. 2) is folded in place between front and rear 14 to close the front edge of the simulated book case 10. To assist in this, a small latch 38 is provided comprising a folding tab member 40 carrying a small keeper or retainer 42 which is removably latched or positioned in place to hold the front flap 32 is position inside case 10 in the manner shown in FIGS. 1 and 2.

Figure 4:
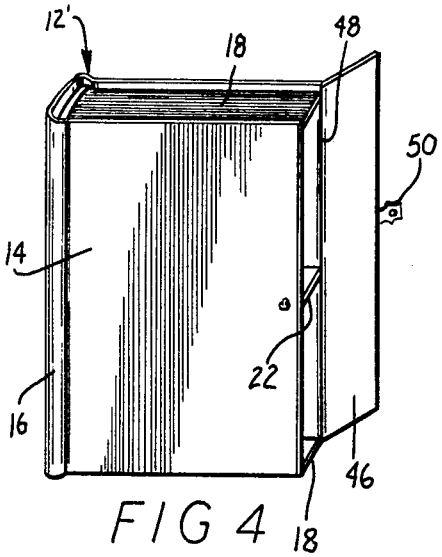
FIG. 4 is a perspective view of a modified form wherein the back is closed by a flap.

In the modified form shown in FIG. 4, the modified case 12' is the same as the case 12 except that a permanent flap 46 is attached by a hinge to the back edge 48 rather than part of the expanding envelope 24 corresponding to flap or panel 32. A latch 50 is provided.

While I have shown and described a particular embodiment of this invention, this is by way of illustration only and does not constitute the only form thereof as there are various alterations, changes, deviations, eliminations, revisions and departures which may be made in the form shown and described without avoiding the scope of the invention as set forth in the appended claims.

What is claimed is:

1. In a filing case which may be manufactured to simulate a book: a case having a hollow interior defined by opposed sides, opposed ends and having one closed edge thereof which may simulate the spline of a book and the other edge thereof spaced from said closed edge having an opening to provide access to the hollow interior compartment; an expanding envelope inserted within said case for removal through said open edge spaced from said spline, said expanding envelope comprising a plurality of individual compartments connected by gussets between opposed edges which may be moved toward or away from one another by expanding or contracting said envelope, whereby said expanding envelope may be removed from said case for the storage of photographs, coupons, or the like within said individual compartments and then compressed and returned to said case to be concealed therein from view when said case is placed on a shelf or the like, and a movable panel attached to and coextensive with one opposed edge and the gusset on said expanding envelope which movable panel may be moved out of the way from in front of the gussets when said envelope is removed from said case and is moved into position over said expanding envelope to conceal the gussets therein when said envelope is positioned within said case, said panel thereby becoming the front closure on said case to close the opening and conceal the envelope therein.

2. The device claimed in claim 1 wherein there is a support shelf and divider member within the compartment in said case and there are at least two expanding envelopes in said case one of which is supported on said divider member.

3. The device claimed in claim 1 wherein there is a support member within the compartment in said case and at least two expanding envelopes within said case one of which rests on said support member.

* * * * *